US009956767B2

(12) United States Patent
Abe

(10) Patent No.: US 9,956,767 B2
(45) Date of Patent: May 1, 2018

(54) LIQUID EJECTING APPARATUS, DRIVE CIRCUIT, AND HEAD UNIT

(71) Applicant: SEIKO EPSON CORPORATION, Tokyo (JP)

(72) Inventor: Akira Abe, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/412,513

(22) Filed: Jan. 23, 2017

(65) Prior Publication Data

US 2017/0246859 A1 Aug. 31, 2017

(30) Foreign Application Priority Data

Feb. 26, 2016 (JP) ..... 2016-034986

(51) Int. Cl.
*B41J 2/045* (2006.01)
*B41J 2/01* (2006.01)

(52) U.S. Cl.
CPC ..... *B41J 2/04541* (2013.01); *B41J 2/0455* (2013.01); *B41J 2/04581* (2013.01); *B41J 2/04588* (2013.01); *B41J 2/04593* (2013.01); *B41J 2/04596* (2013.01); *B41J 2/01* (2013.01)

(58) Field of Classification Search
CPC ..... B41J 2/04541; B41J 2/0455; B41J 2/01; B41J 2/04581; B41J 2/04593; B41J 2/04588; B41J 2/04596
See application file for complete search history.

(56) References Cited

U.S. PATENT DOCUMENTS 7,852,128 B2 12/2010 Kitazawa et al.
2003/0112286 A1* 6/2003 Shindo ..... B41J 2/1652 347/30
2005/0162223 A1* 7/2005 Maejima ..... H03F 3/2171 330/10
2007/0124620 A1* 5/2007 Miyazaki ..... G03B 21/14 713/323
2013/0187967 A1* 7/2013 Abe ..... B41J 2/07 347/11

FOREIGN PATENT DOCUMENTS

JP 2009-190287 A 8/2009
JP 2010-114711 A 5/2010

* cited by examiner

*Primary Examiner* — Yaovi M Ameh
(74) *Attorney, Agent, or Firm* — Global IP Counselors, LLP

(57) ABSTRACT

A liquid ejecting apparatus includes an ejecting unit, a differential amplifier, a pair of transistors, and a selector. The ejecting unit includes a piezoelectric element which is configured to be displaced by a drive signal being applied to the piezoelectric element. The ejecting unit is configured to eject liquid in accordance with displacement of the piezoelectric element. The differential amplifier is configured to output a control signal based on a source drive signal which is a source signal of the drive signal and a signal based on the drive signal. The transistors includes a high-side transistor and a low-side transistor which are configured to be controlled based on the control signal and are configured to output the drive signal from an output terminal of the transistors. The selector is configured to select one of the high-side transistor and the low-side transistor and supply the control signal to a selected transistor.

6 Claims, 10 Drawing Sheets

<DECODED CONTENT OF DECODER>

| | PRINT DATA SI | T1 | | T2 | |
|---|---|---|---|---|---|
| | | Sa | Sb | Sa | Sb |
| LARGE DOT | (1, 1) | H | L | H | L |
| MEDIUM DOT | (0, 1) | H | L | L | H |
| SMALL DOT | (1, 0) | L | L | L | H |
| NO RECORD | (0, 0) | L | H | L | L |

MSB LSB

LIQUID EJECTING APPARATUS, DRIVE CIRCUIT, AND HEAD UNIT

CROSS-REFERENCE TO RELATED APPLICATIONS

This application claims priority to Japanese Patent Application No. 2016-034986 filed on Feb. 26, 2016. The entire disclosure of Japanese Patent Application No. 2016-034986 is hereby incorporated herein by reference.

BACKGROUND

Technical Field

The present invention relates to a liquid ejecting apparatus, a drive circuit, and a head unit.

Related Art

An ink jet printer which uses a piezoelectric element (for example, a piezo element) and which prints an image or a text by ejecting ink is known. Piezoelectric elements are provided in correspondence with multiple nozzles in a head unit, each of the piezoelectric elements is driven in accordance with a drive signal, and thereby, a predetermined amount of ink (liquid) is ejected from the nozzle at a predetermined timing to form dots. The piezoelectric element is electrically a capacitive element like a capacitor, and needs to receive a sufficient current in order to operate the piezoelectric element of each nozzle.

Accordingly, a source drive signal which is a source signal of a drive signal is amplified by an amplification circuit, is supplied to a head unit as a drive signal, and drives the piezoelectric elements. An amplification circuit uses a method (linear amplification, refer to JP-A-2009-190287) of amplifying current for the source drive signal in a class AB amplification or the like. However, since power consumption increases and energy efficiency decreases in the linear amplification, a class D amplification is also proposed in recent years (refer to JP-A-2010-114711). In short, in a class D amplification, a pulse width modulation or a pulse density modulation of the source drive signal is performed, a high-side transistor and a low-side transistor that are inserted in series between power supply voltages are switched in accordance with the modulated signal, an output signal which is generated by the switching is filtered by a low pass filter, and thus, the source drive signal is amplified.

Energy efficiency of a class D amplification method is higher than that of a linear amplification method, however, power which is consumed by a low pass filter cannot be ignored, and thus, there is room for improvement in terms of reducing power consumption.

SUMMARY

An advantage of some aspects of the invention is to provide a liquid ejecting apparatus, a drive circuit, and a head unit which reduce power consumption.

A liquid ejecting apparatus according to an aspect of the invention includes an ejecting unit, a differential amplifier, a pair of transistors, and a selector. The ejecting unit includes a piezoelectric element which is configured to be displaced by a drive signal being applied to the piezoelectric element. The ejecting unit is configured to eject liquid in accordance with displacement of the piezoelectric element. The differential amplifier is configured to output a control signal based on a source drive signal which is a source signal of the drive signal and a signal based on the drive signal. The pair of the transistors includes a high-side transistor and a low-side transistor which are controlled based on the control signal and is configured to output the drive signal from an output terminal of the pair of the transistors. The select unit is configured to select one of the high-side transistor and the low-side transistor and supply the control signal to a selected transistor of the pair of the transistors.

In the liquid ejecting apparatus according to the aspect, the selector is configured to turn off the high-side transistor and the low-side transistor, while a voltage of the source drive signal changes to be lower than or equal to a threshold value.

In the liquid ejecting apparatus according to the aspect, the selector is configured to turn off the high-side transistor and the low-side transistor, while an OFF designation signal indicating that the voltage of the source drive signal changes to be lower than or equal to the threshold value is input.

In the liquid ejecting apparatus according to the aspect, the selector is configured to select the high-side transistor in a period in which a voltage of the source drive signal increases, and select the low-side transistor in a period in which the voltage of the source drive signal decreases.

In addition, in the liquid ejecting apparatus according to the aspect, the ejecting unit, the differential amplifier, the pair of the transistors, and the selector are mounted on a movable carriage.

According to another aspect of the invention, a drive circuit, which is configured to drive a capacitive load in response to a drive signal, comprises a differential amplifier, a pair of transistors, and a selector. The differential amplifier is configured to output a control signal based on a difference voltage between a source drive signal which is a source signal of the drive signal and a signal based on the drive signal. The transistors include a high-side transistor and a low-side transistor which are configured to be controlled based on the control signal. The transistors are configured to output the drive signal from an output terminal of the transistors. The selector is configured to select one of the high-side transistor and the low-side transistor and supply the control signal to a selected transistor of the transistors.

According to another aspect of the invention, a head unit comprises an ejecting unit. The ejecting unit includes a piezoelectric element that is configured to be displaced by a drive signal being applied to the piezoelectric element. The ejecting unit is configured to eject liquid in accordance with displacement of the piezoelectric element. The ejecting unit is configured to be driven by a drive circuit which includes a differential amplifier, a pair of transistors, and a selector. The differential amplifier is configured to output a control signal based on a difference voltage between a source drive signal which is a source signal of the drive signal and a signal based on the drive signal. The transistors include a high-side transistor and a low-side transistor which are configured to be controlled based on the control signal, and are configured to output the drive signal from an output terminal of the transistors. The selector is configured to select one of the high-side transistor and the low-side transistor and supply the control signal to a selected transistor of the transistors.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, a printing apparatus according to an exemplary embodiment of the invention will be described with reference to the drawings.

Figure 1:
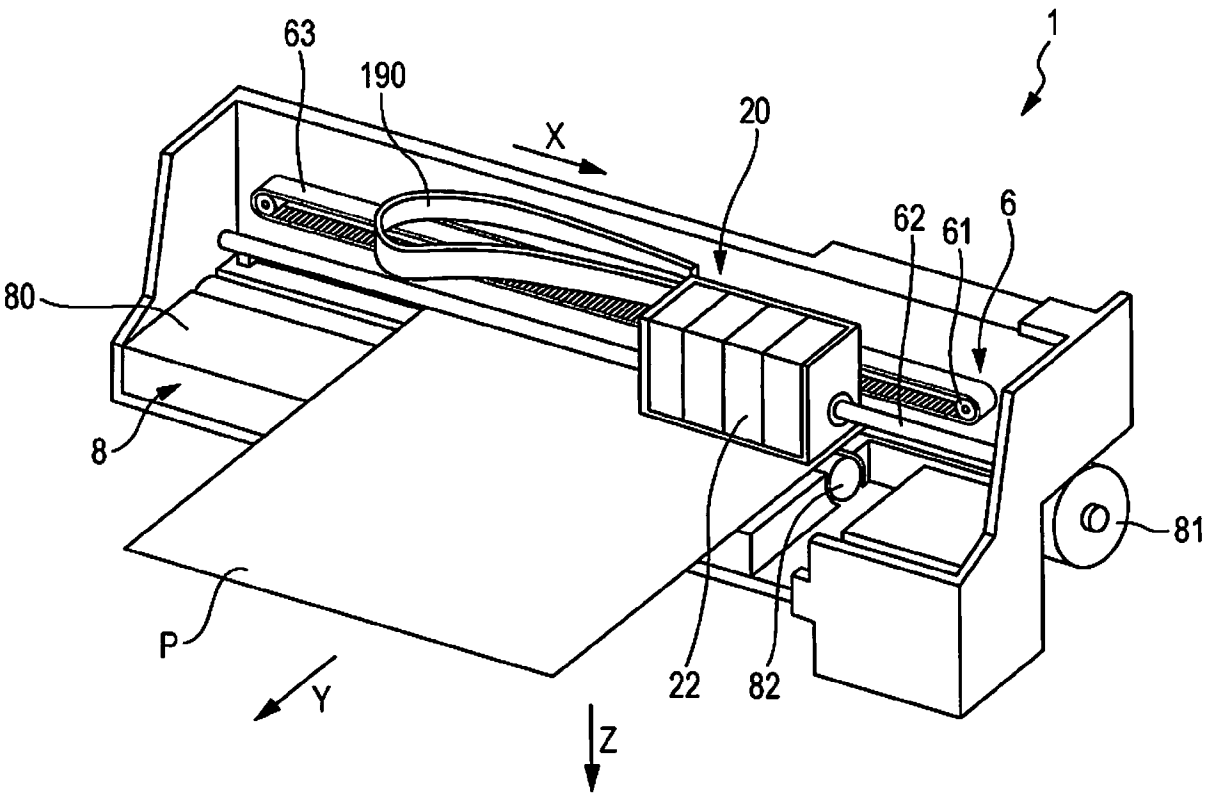
FIG. 1 is a perspective view illustrating a schematic configuration of a printing apparatus.

FIG. 1 is a perspective view illustrating a schematic configuration of a printing apparatus.

The printing apparatus illustrated in this figure is a type of liquid ejecting apparatus which ejects ink that is an example of liquid, thereby, forming an ink dot group on a medium P such as paper, thereby, printing an image (including characters, graphics, or the like).

As illustrated in FIG. 1, the printing apparatus 1 includes a moving mechanism 6 which moves (moves back and forth) a carriage 20 in a main scanning direction (X direction).

The moving mechanism 6 includes a carriage motor 61 which moves the carriage 20, a carriage guide axis 62 both of which are fixed, and a timing belt 63 which extends substantially parallel to the carriage guide axis 62 and is driven by the carriage motor 61.

The carriage 20 is supported by the carriage guide axis 62 so as to move freely back and forth, and is fixed to a part of the timing belt 63. Accordingly, if the timing belt 63 travels forward and backward by the carriage motor 61, the carriage 20 is guided by the carriage guide axis 62 and moves back and forth.

A printing head 22 is mounted in the carriage 20. The printing head 22 includes multiple nozzles which respectively eject ink in the Z direction onto a portion which faces the medium P. The printing head 22 is divided into approximately four blocks for color printing. The multiple blocks respectively eject black (Bk) ink, cyan (C) ink, magenta (M) ink, and yellow (Y).

There is provided a configuration in which various control signals or the like, which include a drive signal from a main substrate (omitted in FIG. 1) through a flexible flat cable 190, are supplied to the carriage 20.

The printing apparatus 1 includes a transport mechanism 8 which transports the medium P on a platen 80. The transport mechanism 8 includes a transport motor 81 which is a drive source, and a transport roller 82 which is rotated by the transport motor 81 and transports the medium P in a sub-scanning direction (Y direction).

In the configuration, an image is formed on a surface of the medium P by ejecting ink in response to print data from the nozzles of the printing head 22 in accordance with main scanning of the carriage 20, and repeating an operation of transporting the medium P in accordance with the transport mechanism 8.

In the present embodiment, the main scanning is performed by moving the carriage 20, but may be performed by moving the medium P, and may be performed by moving both the carriage 20 and the medium P. The point is that there may be provided a configuration in which the medium P and the carriage 20 (printing head 22) move relatively.

Figure 2A:
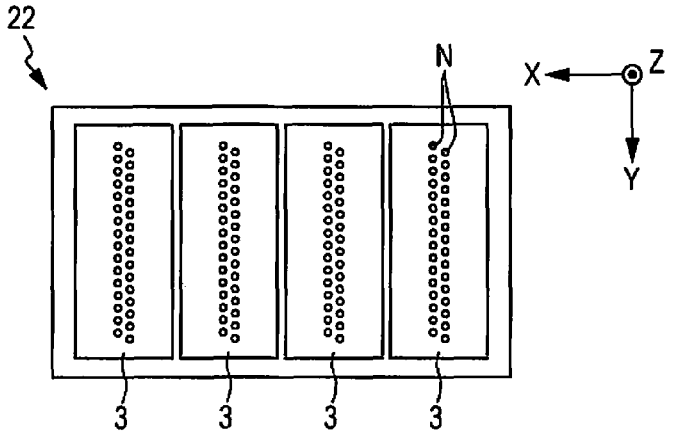
FIG. 2A is a diagram illustrating arrangement or the like of nozzles in a head unit.

FIG. 2A is a diagram illustrating a configuration in a case in which an ejecting surface of ink in the printing head 22 is viewed from the medium P. As illustrated in FIG. 2A, the printing head 22 includes four head units 3. The four head units 3 are arranged in the X direction which is a main scanning direction in correspondence with black (Bk), cyan (C), magenta (M), and yellow (Y), respectively.

Figure 2B:
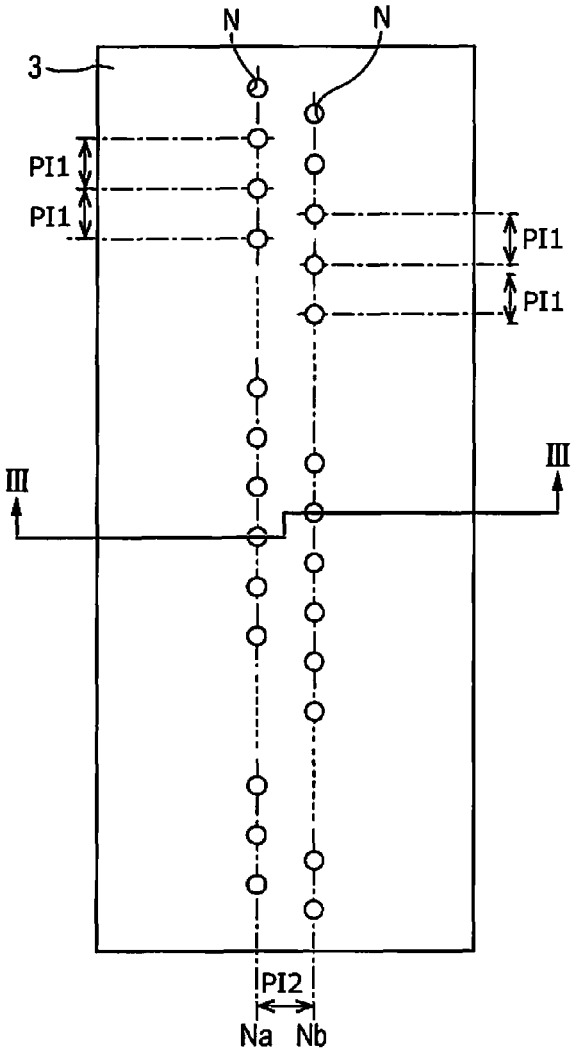
FIG. 2B is a diagram illustrating arrangement or the like of the nozzles in the head unit.

FIG. 2B is a diagram illustrating arrangement of nozzles in one head unit 3.

As illustrated in FIG. 2B, multiple nozzles N are arranged in two columns in one head unit 3. For the sake of convenience, the two columns are respectively referred to as a nozzle column Na and a nozzle column Nb.

Multiple nozzles N are arranged in the Y direction which is a subscan direction by a pitch PI1 in each of the nozzle columns Na and Nb. In addition, the nozzle columns Na and Nb are separated from each other by a pitch PI2 in the X direction. The nozzles N in the nozzle column Na are shifted from the nozzles N in the nozzle column Nb by half of the pitch PI1 in the Y direction.

In this way, the nozzles N are arranged so as to be shifted by half of the pitch PI1 in the two columns of the nozzle columns Na and Nb in the Y direction, and thereby it is possible to increase resolution in the Y direction substantially twice as much as a case of one column.

The number of nozzles N in one head unit 3 is referred to as m (m is an integer greater than or equal to 2) for the sake of convenience.

While not particularly illustrated, the head unit 3 has a configuration in which a flexible circuit board is coupled to an actuator substrate, and a drive IC is mounted on the flexible circuit board. Hence, next, a structure of the actuator substrate will be described.

Figure 3:
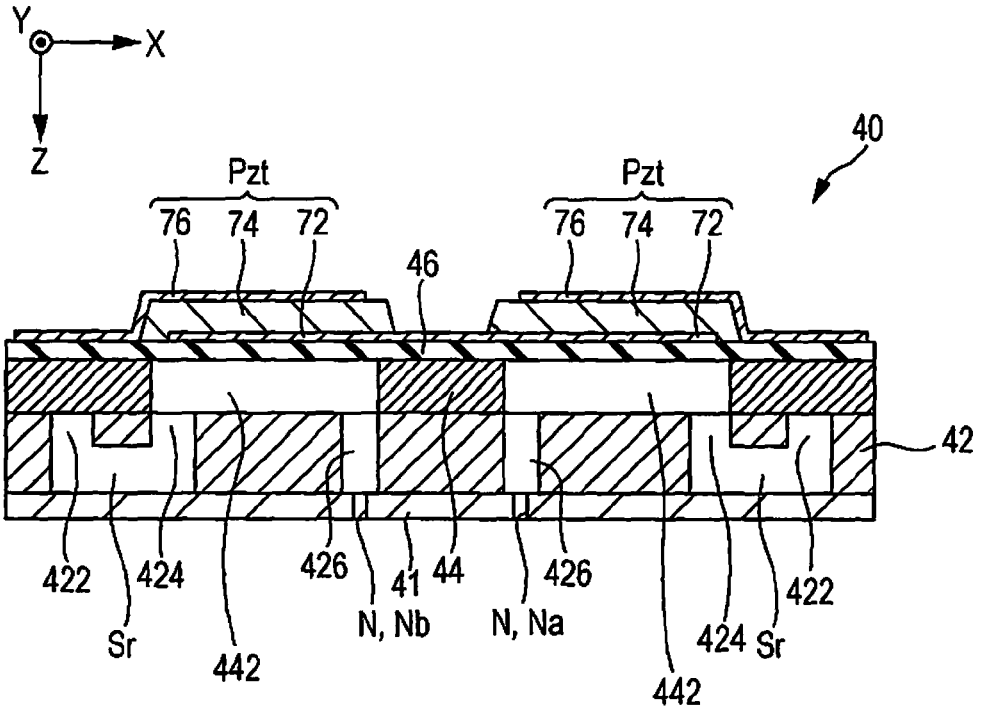
FIG. 3 is a sectional view illustrating a main configuration of the head unit.

FIG. 3 is a sectional view illustrating a structure of the actuator substrate. In detail, FIG. 3 is a view illustrating a cross section taken along line III-III of FIG. 2B.

As illustrated in FIG. 3, the actuator substrate 40 has a structure in which a pressure chamber substrate 44 and a vibration plate 46 are provided on a surface of a slow path substrate 42 at a negative side in the Z direction and a nozzle plate 41 is provided on a surface of the flow path substrate 42 at a positive side in the Z direction.

Schematically, each element of the actuator substrate 40 is a member of an approximately flat plate which is long in the Y direction, and is fixed to each other by for example, an adhesive or the like. In addition, the flow path substrate 42 and the pressure chamber substrate 44 are formed by, for example, a single crystal substrate of silicon.

The nozzles N are formed in the nozzle plate 41. A structure corresponding to the nozzles in the nozzle column Na is shifted from a structure corresponding to the nozzles in the nozzle column Nb by half of the pitch PI1 in the Y direction, but the nozzles are formed approximately symmetrically except for that, and thus, the structure of the actuator substrate 40 will be hereinafter described by focusing on the nozzle column Na.

The flow path substrate 42 is a flat member which forms a flow path of ink, and includes an opening 422, a supply flow path 424, and a communication flow path 426. The supply flow path 424 and the communication flow path 426 are formed in each nozzle, and the opening 422 is continuously formed over the multiple nozzles and has a structure in which ink with a corresponding color is supplied. The opening 422 functions as a liquid reservoir chamber Sr, and a bottom surface of the liquid reservoir chamber Sr is configured by, for example, the nozzle plate 41. In detail, the nozzle plate 41 is fixed to the bottom surface of the flow path substrate 42 so as to close the opening 422, the supply flow path 424, and the communication flow path 426 which are in the flow path substrate 42.

The vibration plate 46 is installed on a surface of the pressure chamber substrate 44 at a side opposite to the flow path substrate 42. The vibration plate 46 is a member of an elastically vibratile flat plate, and is configured by stacking an elastic film formed of an elastic material such as a silicon oxide, and an insulating film formed of an insulating material such as a zirconium oxide. The vibration plate 46 and the flow path substrate 42 face each other with an interval in the inner side of each opening 422 of the pressure chamber substrate 44. A space between the flow path substrate 42 and the vibration plate 46 in the inner side of each opening 422 functions as a cavity 442 which provides pressure to ink. Each cavity 442 communicates with the nozzle N through the communication flow path 426 of the flow path substrate 42.

A piezoelectric element Pzt is formed for each nozzle N (cavity 442) on a surface of the vibration plate 46 at a side opposite to the pressure chamber substrate 44.

The piezoelectric element Pzt includes a common drive electrode 72 formed over the multiple piezoelectric elements Pzt formed on a surface of the vibration plate 46, a piezoelectric body 74 formed on a surface of the common drive electrode 72, and individual drive electrodes 76 formed in each piezoelectric element Pzt on a surface of the piezoelectric body 74. In the configuration, a region in which the piezoelectric body 74 is interposed between the common drive electrode 72 and the drive electrode 76 which face each other, functions as the piezoelectric element Pzt.

The piezoelectric body 74 is formed in a process which includes, for example, a heating process (baking). In detail, the piezoelectric body 74 is formed by baking a piezoelectric material which is applied to a surface of the vibration plate 46 on which multiple common drive electrodes 72 are formed, using heating processing of a furnace, and then molding (milling by using, for example, plasma) the baked material for each piezoelectric element Pzt.

In the same manner, the piezoelectric element Pzt corresponding to the nozzle column Nb is also configured to include the common drive electrode 72, the piezoelectric body 74, and the drive electrode 76.

In addition, in this example, in the piezoelectric body 74, the common drive electrode 72 is used as a lower layer and the individual drive electrodes 76 are used as an upper layer, but in contrast to this, a configuration in which the common drive electrode 72 is used as an upper layer and the individual drive electrodes 76 are used as a lower layer, may be provided.

A configuration may be provided in which the drive IC is directly mounted in the actuator substrate 40.

As will be described below, meanwhile a voltage Vout of a drive signal according to the amount of ink to be ejected is individually applied to the drive electrode 76 which is a terminal of the piezoelectric element Pzt, a retention signal of a voltage $V_{BS}$ is commonly applied to the drive electrode 72 which is the other terminal of the piezoelectric element Pzt.

Accordingly, the piezoelectric element Pzt becomes displaced upwardly or downwardly in accordance with a voltage which is applied to the drive electrodes 72 and 76. In detail, if the voltage Vout of the drive signal which is applied through the drive electrode 76 decreases, the central portion of the piezoelectric element Pzt is bent upwardly with respect to both end portions, and meanwhile, if the voltage Vout increases, the central portion of the piezoelectric element Pzt is bent downwardly.

If the central portion is bent upwardly, an internal volume of the cavity 442 increases (pressure decreases), and thus ink is drawn from the liquid reservoir chamber Sr. Meanwhile, if the central portion is bent downwardly, an internal volume of the cavity 442 decreases (pressure increases), and thus, an ink droplet is ejected from the nozzle N in accordance with the decreased degree. In this way, if a proper drive signal is applied to the piezoelectric element Pzt, ink is ejected from the nozzle N in accordance with the displacement of the piezoelectric element Pzt. Accordingly, an ejecting unit which ejects ink in accordance with at least the piezoelectric element Pzt, the cavity 442, and the nozzle N, is configured.

Next, an electrical configuration of the printing apparatus 1 will be described.

Figure 4:
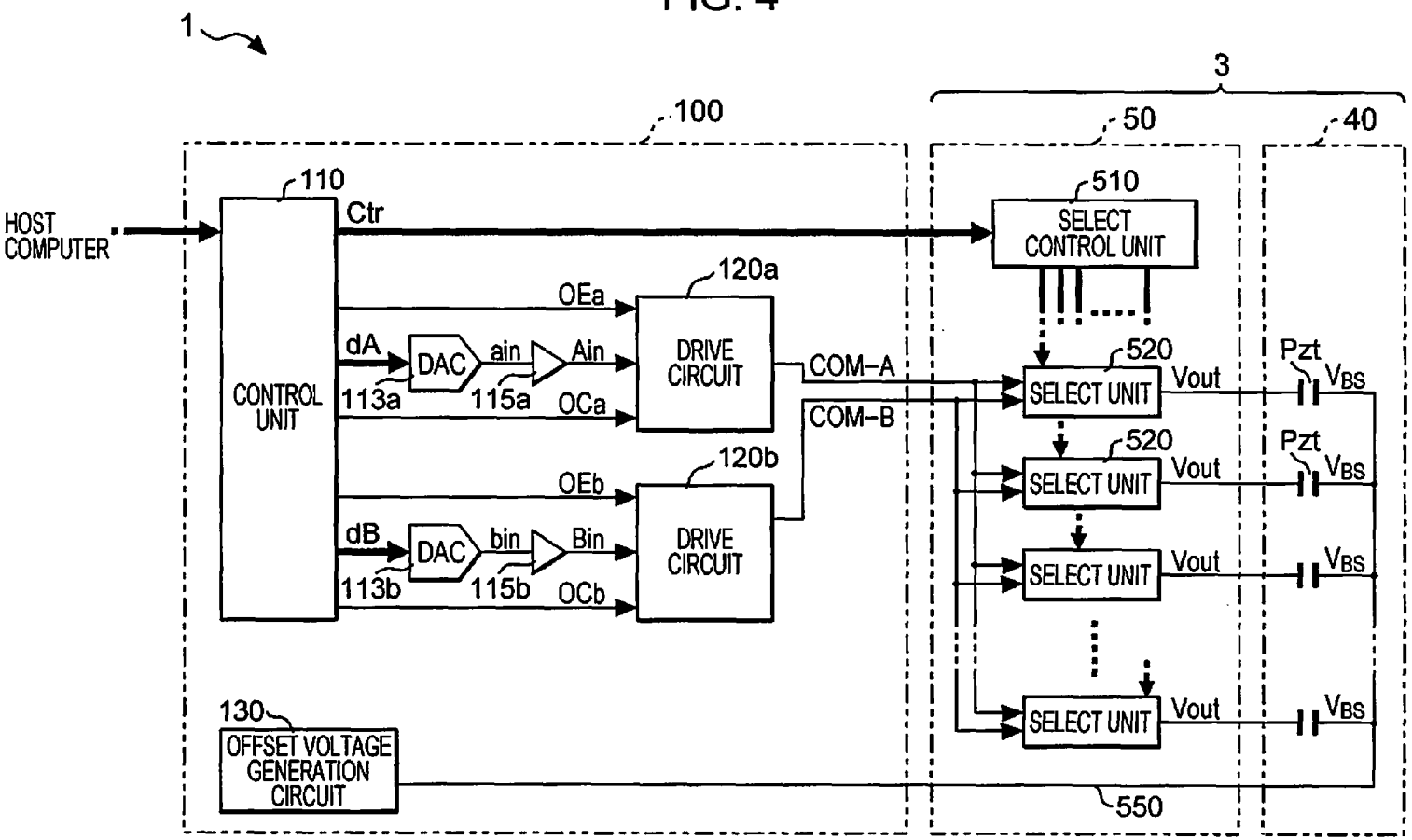
FIG. 4 is a block diagram illustrating an electrical configuration of the printing apparatus.

FIG. 4 is a block diagram illustrating an electrical configuration of the printing apparatus 1.

As illustrated in FIG. 4, the printing apparatus 1 has a configuration in which the head unit 3 is coupled to a main substrate 100 through the flexible flat cable (not illustrated in FIG. 4). The head unit 3 is largely divided into the actuator substrate 40 and a drive IC 50.

The main substrate 100 supplies a control signal Ctr or drive signals COM-A and COM-B to the drive IC 50, and supplies a retention signal of the voltage $V_{BS}$ (offset voltage) to the actuator substrate 40 through a wire 550.

In the printing apparatus 1, four head units 3 are provided, and the main substrate 100 independently controls the four head units 3. The four head units 3 are the same as each other except that the colors of ink to be ejected are different from each other, and thus, hereinafter, one head unit 3 will be representatively described for the sake of convenience.

As illustrated in FIG. 4, the main substrate 100 includes a control unit 110, D/A converters (DAC) 113*a* and 113*b*, voltage amplifiers 115*a* and 115*b*, drive circuits 120*a* and 120*b*, and an offset voltage generation circuit 130.

Among these, the control unit 110 is a type of a microcontroller having a CPU, a RAM, a ROM, and the like, and outputs various control signals or the like for controlling each unit by executing a predetermined program, when image data which becomes a printing target is supplied from a host computer or the like.

In detail, first, the control unit 110 repeatedly supplies digital data dA to the DAC 113*a*, and repeatedly supplies digital data dB to the DAC 113*b* in the same manner. Here, the data dA defines a waveform of the drive signal COM-A which is supplied to the head unit 3, and the data dB defines a waveform of the drive signal COM-B.

Second, the control unit 110 outputs signals OEa and OCa in accordance with supplying of the data dA and outputs signals OEb and OCb in accordance with supplying of the data dB.

The DAC 113*a* converts the digital data dA into analog signal ain. The voltage amplifier 115*a* amplifies a voltage of the signal ain by, for example, 10 times and supplies the voltage to the drive circuit 120*a* as a signal Ain. In the same manner, the DAC 113*b* converts the digital data dB into analog signal bin, and the voltage amplifier 115*b* amplifies a voltage of the signal bin by, for example, 10 times and supplies the voltage to the drive circuit 120*b* as a signal Bin.

The drive circuit 120*a*, which will be described below in detail, outputs the signal Ain to the piezoelectric element Pzt which is a capacitive load as the drive signal COM-A by increasing drive capability (converting to low impedance). In the same manner, the drive circuit 120*b* outputs the signal Bin as the drive signal COM-B by increasing drive capability.

The drive signal COM-A (signal ain after being converted through analog conversion, signal Ain before being converted through impedance conversion) has a trapezoidal waveform as will be described below, and the signals OEa and OCa are output according to the trapezoidal waveform. In the same manner, the drive signal COM-B (signal bin after being converted through analog conversion, signal Bin before being converted through impedance conversion) also has a trapezoidal waveform, and the signals OEb and OCb are output according to the trapezoidal waveform. Waveforms of the drive signals COM-A and COM-B and the signals OEa, OCa, OEb, and OCb will be described below.

The signal Ain (Bin) which is converted by the DAC 113*a* (113*b*) performs a relatively small swing in a range of a voltage of, for example, approximately 0 V to 4 V, and in contrast to this, the drive signal COM-A (COM-B) performs a relatively large swing in a range of a voltage of, for example, approximately 0 V to 40 V. Accordingly, there is provided a configuration in which the voltage amplifier 115*a* (115*b*) amplifies a voltage of the signal ain (bin) which is converted by the DAC 113*a* (113*b*), and the drive circuit 120*a* (120*b*) impedance-converts the signal Ain (Bin) whose voltage is amplified.

Third, the control unit 110 supplies various control signals Ctr to the head unit 3, in synchronization with control for the moving mechanism 6 and the transport mechanism 8. The control signals Ctr which are supplied to the head unit 3 include print data (ejecting control signal) which defines the amount of ink which is ejected from the nozzle N, a clock signal which is used for transmission of the print data, a timing signal which defines a print period or the like, or the like.

The control unit 110 controls the moving mechanism 6 and the transport mechanism 8, but such a configuration is known, and thus, description thereof will be omitted.

The offset voltage generation circuit 130 in the main substrate 100 generates a retention signal of the voltage $V_{BS}$ and commonly applies the signal to the other terminals of the multiple piezoelectric elements Pzt in the actuator substrate 40 through the wires 550. The retention signal of the voltage $V_{BS}$ maintains the other terminals of the multiple piezoelectric elements Pzt in a constant state.

Meanwhile, in the head unit 3, the drive IC 50 includes a select control unit 510 and select units 520 which correspond to the piezoelectric elements Pzt one to one. The select control unit 510 controls selection of each of the select units 520. In detail, the select control unit 510 stores the print data which is supplied in correspondence with a clock signal from the control unit 110 in several nozzles (piezoelectric elements Pzt) of the head unit 3 once, and instructs each select unit 520 to select the drive signals COM-A and COM-B in accordance with the print data at a start timing of a print period which is defined by a timing signal.

Each select unit 520 selects (or does not select any one) one of the drive signals COM-A and COM-B in accordance with instruction of the select control unit 510, and applies the selected signal to one terminal of the corresponding piezoelectric element Pzt as a drive signal of the voltage Vout.

As described above, one piezoelectric element Pzt is provided for each nozzle N in the actuator substrate 40. The other terminals of each piezoelectric element Pzt are coupled in common, and the voltage $V_{BS}$ from the offset voltage generation circuit 130 is applied to the other terminals through the wire 550.

In the present embodiment, ink is ejected from one nozzle N maximum twice by one dot, and thus four gradations of a large dot, a medium dot, a small dot, and no record are represented. In the present embodiment, in order to represent the four gradations, two types of the drive signals COM-A and COM-B are prepared, and each period has a first half pattern and a second half pattern. Then, during one period, the drive signals COM-A and COM-B are selected (or not selected) in accordance with a gradation to be represented in the first half and a second half, and the selected signal is supplied to the piezoelectric element Pzt.

Thus, the drive signals COM-A and COM-B will be first described, and thereafter, a detailed configuration of the select control unit 510 for selecting the drive signals COM-A and COM-B, and the select unit 520 will be described.

Figure 5:
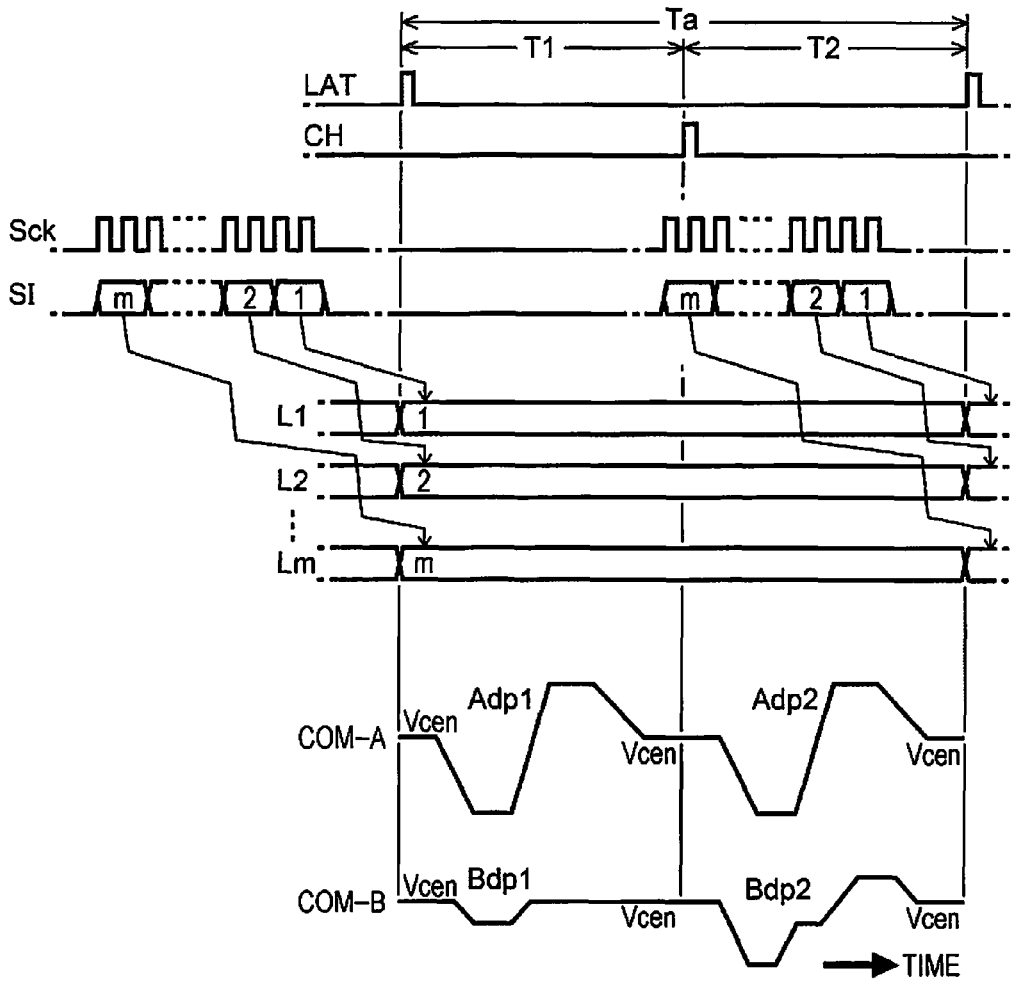
FIG. 5 is a diagram illustrating waveforms and the like of drive signals.

FIG. 5 is a diagram illustrating waveforms or the like of drive signals COM-A and COM-B.

As illustrated in FIG. 5, the drive signal COM-A is configured by a repeated waveform of a trapezoidal waveform Adp1 which is disposed during a period T1 from time when a control signal LAT is output (rises) to time when a control signal CH is output, during a print period Ta, and a trapezoidal waveform Adp2 which is disposed during a period T2 from time when the control signal CH is output and to the control signal LAT is output during the print period Ta.

In the present embodiment, the trapezoidal waveforms Adp1 and Adp2 are approximately the same waveforms as each other, and are waveforms which eject ink of a predetermined amount, specifically, an approximately medium amount from the nozzle N corresponding to the piezoelectric elements Pzt, if each waveform is supplied to the drive electrode 76 which is one terminal of the piezoelectric elements Pzt.

The drive signal COM-B is configured by a repeated waveform of a trapezoidal waveform Bdp1 which is disposed during the period T1 and a trapezoidal waveform Bdp2 which is disposed during the period T2. In the present embodiment, the trapezoidal waveforms Bdp1 and Bdp2 are waveforms different form each other. Among these, the trapezoidal waveform Bdp1 is a waveform for preventing an increase of viscosity of ink by slightly vibrating the ink near the nozzle N. Accordingly, even if the trapezoidal waveform Bdp1 is supplied to the one terminal of the piezoelectric element Pzt, ink is not ejected from the nozzle N corresponding to the piezoelectric element Pzt. In addition, the trapezoidal waveform Bdp2 is a waveform different from the trapezoidal waveform Adp1 (Adp2). If the trapezoidal waveform Bdp2 is supplied to the one terminal of the piezoelectric element Pzt, the trapezoidal waveform Bdp2 becomes a waveform which ejects the amount of ink less than the predetermined amount from the nozzle N corresponding to the piezoelectric element Pzt.

Voltages at a start timing of the trapezoidal waveforms Adp1, Adp2, Bdp1, and Bdp2, and voltages at an end timing of the trapezoidal waveforms Adp1, Adp2, Bdp1, and Bdp2 are all common at a voltage Vcen. That is, the trapezoidal waveforms Adp1, Adp2, Bdp1, and Bdp2 are waveforms which respectively start at the voltage Vcen and ends at the voltage Vcen.

In the present example, since the drive circuit 120*a* (120*b*) impedance-converts the signal Ain (Bin), a waveform of the signal Ain (Bin) which is input has some errors, but may be approximately the same as a waveform of the drive signal COM-A (COM-B). Meanwhile, since the signal Ain (Bin) is obtained by amplifying a voltage of the signal ain (bin) by 10 times, the waveform of the signal ain (bin) is 1/10 of the signal Ain (Bin). Since the signal ain (bin) is obtained by analog-converting the data dA (dB), a voltage waveform of the drive signal COM-A (COM-B) is defined by the control unit 110.

The control unit 110 outputs a signal OCa (select signal) and a signal OEa (off designation signal) having the following logic level with respect to the trapezoidal waveform of the drive signal COM-A (COM-B) to the drive circuit 120*a*.

In detail, the control unit 110 causes the signal OCa to be in a High (H) level during a period in which a voltage of the drive signal COM-A (signal Ain) decreases and a period in which the drive signal COM-A is constant at a voltage lower than a threshold value Vth, and other than that, to be in a Low (L) level during a period in which the voltage of the drive signal COM-A increases and a period in which the drive signal COM-A is constant at a voltage higher than the threshold value Vth.

In the present example, when a maximum value of the voltage of the drive signal COM-A (signal Ain) is referred to as max and a minimum value thereof is referred to as min, description will be made by assuming that a relationship of max>Vth>Vcen>min is satisfied for the sake of convenient. The relationship may be max>Vcen>Vth>min.

In addition, the control unit 110 causes the signal OEa to be in an H level during a period in which a voltage of the drive signal COM-A (signal Ain) is constant, and to be in an L level during other periods (a voltage increase period and a voltage decrease period of the drive signal COM-A).

In the same manner, the control unit 110 outputs a signal OCb having the following logic level with respect to the trapezoidal waveform of the drive signal COM-B to the drive circuit 120*b*. In detail, the control unit 110 causes the signal OCb to be in an H level during a period in which a voltage of the drive signal COM-B (signal Bin) decreases and a period in which the drive signal COM-B is constant at a voltage lower than the threshold value Vth, and other than that, to be in an L level during a period in which the voltage of the drive signal COM-B increases and a period in which the drive signal COM-B is constant at a voltage higher than the threshold value Vth.

In addition, the control unit 110 causes the signal OEb to be in an H level during a period in which a voltage of the drive signal COM-B (signal Bin) is constant, and to be in an L level during other periods (a voltage increase period and a voltage decrease period of the drive signal COM-B).

Figure 6:
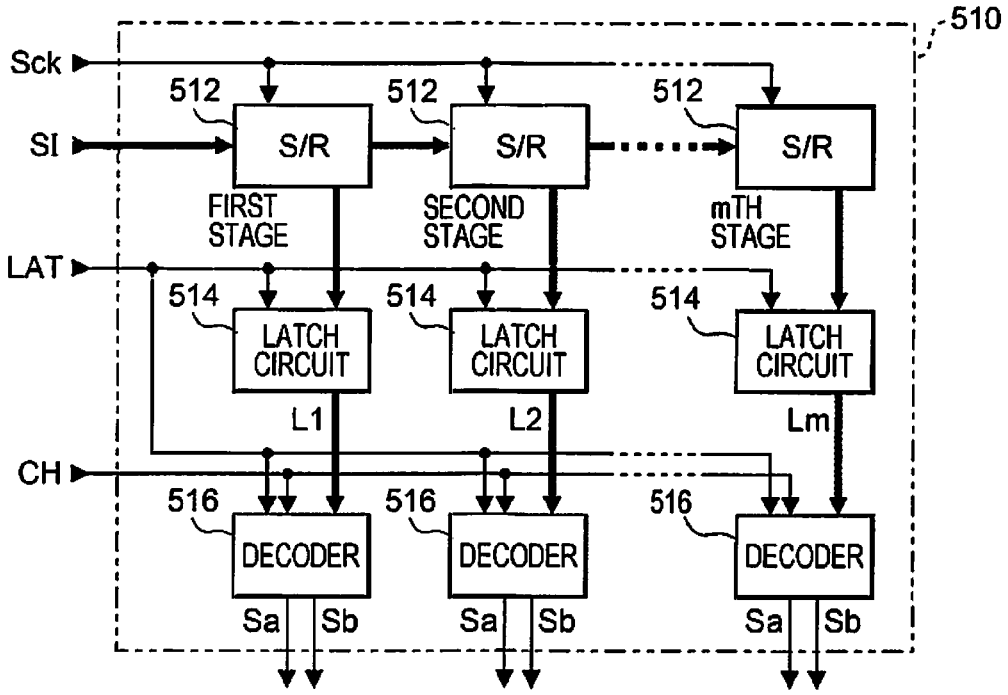
FIG. 6 is a diagram illustrating a configuration of a select control unit.

FIG. 6 is a diagram illustrating a configuration of the select control unit 510 of FIG. 4.

As illustrated in FIG. 6, a clock signal Sck, the print data SI, and the control signals LAT and CH are supplied to the select control unit 510. Each of multiple sets of a shift register (SIR) 512, a latch circuit 514, and a decoder 516 are provided in correspondence with each of the piezoelectric elements Pzt (nozzles N) in the select control unit 510.

The print data SI is data which defines dots to be formed by all the nozzles N in the head unit 3 which is focused during the print period Ta. In the present embodiment, in order to represent the four gradations of no record, a small dot, a medium dot, and a large dot, the print data for one nozzle is configured by two bits of a most significant bit (MSB) and a least significant bit (LSB).

The print data SI is supplied in accordance with transport of the medium P for each nozzle N (piezoelectric element Pzt) in synchronization with the clock signal Sck. The shift register 512 has a configuration in which the print data SI of two bits is retained once in correspondence with the nozzle N.

In detail, shift registers 512 of total m stages corresponding to m piezoelectric elements Pzt (nozzles) are coupled in cascade, and the print data SI which is supplied to the shift register 512 of a first stage located at a left end of FIG. 6 is sequentially transmitted to the rear stage (downstream side) in accordance with the clock signal Sck.

In FIG. 6, in order to separate the shift registers 512, the shift register 512 are sequentially referred to as a first stage, a second stage, . . . , an mth stage from the upstream side to which the print data SI is supplied.

The latch circuit 514 latches the print data SI retained in the shift register 512 at a rising edge of the control signal LAT.

The decoder 516 decodes the print data SI of two bits which are latched in the latch circuit 514, outputs select signals Sa and Sb for each of periods T1 and T2 which are defined by the control signal LAT and the control signal CH, and defines selection of the select unit 520.

Figures 7, 8:
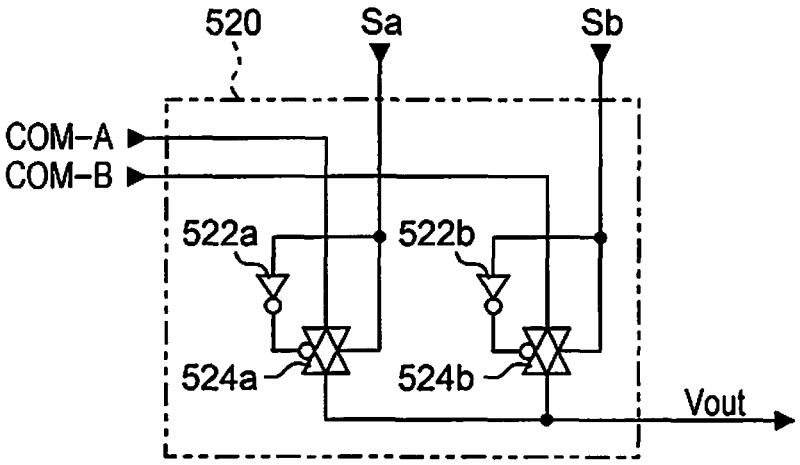
FIG. 7 is a diagram illustrating decoded content of a decoder.
FIG. 8 is a diagram illustrating a configuration of a select unit.

FIG. 7 is a diagram illustrating decoded content of the decoder 516.

In FIG. 7, the print data SI of two bits which are latched is referred to as an MSB and an LSB. In the decoder 516, if the latched print data SI is (0,1), it means that logic levels of the select signals Sa and Sb are respectively output as levels of H and L during the period T1, and levels of L and H during the period T2.

The logic levels of the select signals Sa and Sb are level-shifted by a level shifter (not illustrated) to a higher amplitude logic than the logic levels of the clock signal Sck, the print data SI, and the control signals LAT and CH.

FIG. 8 is a diagram illustrating a configuration of the select unit 520 of FIG. 4.

As illustrated in FIG. 8, the select unit 520 includes inverters (NOT circuit) 522*a* and 522*b*, and transfer gates 524*a* and 524*b*.

The select signal Sa from the decoder 516 is supplied to a positive control terminal to which a round mark is not attached in the transfer gate 524*a*, is logically inverted by the inverter 522*a*, and is supplied to a negative control terminal to which a round mark is attached in the transfer gate 524*a*. In the same manner, the select signal Sb is supplied to a positive control terminal of the transfer gate 524*b*, is logically inverted by the inverter 522*b*, and is supplied to a negative control terminal of the transfer gate 524*b*.

The drive signal COM-A is supplied to an input terminal of the transfer gate 524*a*, and the drive signal COM-B is supplied to an input terminal of the transfer gate 524*b*. The output terminals of the transfer gates 524*a* and 524*b* are coupled to each other, and are coupled to one terminal of the corresponding piezoelectric element Pzt.

If the select signal Sa is in an H level, the input terminal and the output terminal of the transfer gate 524*a* are electrically coupled (ON) to each other. If the select signal Sa is in an L level, the input terminal and the output terminal of the transfer gate 524*a* are electrically decoupled (OFF) from each other. In the same manner, the input terminal and the output terminal of the transfer gate 524*b* are also electrically coupled to each other or decoupled from each other in accordance with the select signal Sb.

As illustrated in FIG. 5, the print data SI is supplied to each nozzle in synchronization with the clock signal Sck, and is sequentially transmitted to the shift registers 512 corresponding to the nozzles. Thus, if supply of the clock signal Sck is stopped, the print data SI corresponding to each nozzle is retained in each of the shift registers 512.

If the control signal LAT rises, each of the latch circuits 514 latches all of the print data SI retained in the shift registers 512. In FIG. 5, the number in L1, L2, . . . , Lm indicate the print data SI which is latched by the latch circuits 514 corresponding to the shift registers 512 of the first stage, the second stage, . . . , the mth stage.

The decoder 516 outputs the logic levels of the select signals Sa and Sb in the content illustrated in FIG. 7 in accordance with the size of the dots which are defined by the latched print data SI during the periods T1 and T2.

That is, first, the decoder 516 sets the select signals Sa and Sb to levels of H and L during the period T1 and levels of H and L even during the period T2, if the print data SI is (1,1) and the size of the large dot is defined. Second, the decoder 516 sets the select signals Sa and Sb to levels of H and L during the period T1 and levels of L and H during the period T2, if the print data SI is (0,1) and the size of the medium dot is defined. Third, the decoder 516 sets the select signals Sa and Sb to levels of L and L during the period T1 and levels of L and H during the period T2, if the print data SI is (1,0) and the size of the small dot is defined. Fourth, the decoder 516 sets the select signals Sa and Sb to levels of L and H during the period T1 and levels of L and L during the period T2, if the print data SI is (0,0) and no record is defined.

Figure 9:
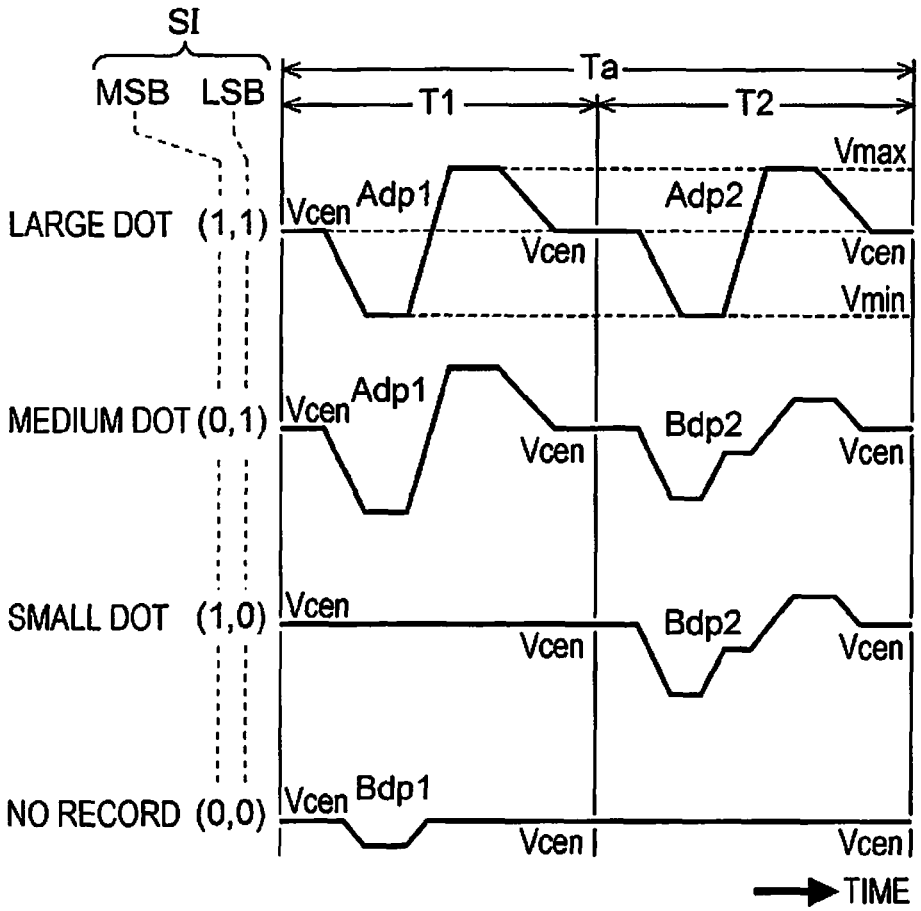
FIG. 9 is a diagram illustrating the drive signals which are supplied from the select unit to a piezoelectric element.

FIG. 9 is a diagram illustrating waveforms of the drive signals which are selected in accordance with the print data SI and are supplied to one terminal of the piezoelectric element Pzt.

When the print data SI is (1,1), the select signals Sa and Sb become H and L levels during the period T1, and thus the transfer gate 524*a* is turned on, and the transfer gate 524*b* is turned off. Accordingly, the trapezoidal waveform Adp1 of the drive signal COM-A is selected during the period T1. Since the select signals Sa and Sb are in H and L levels even during the period T2, the select unit 520 selects the trapezoidal waveform Adp2 of the drive signal COM-A.

In this way, if the trapezoidal waveform Adp1 is selected during the period T1, the trapezoidal waveform Adp2 is selected during the period T2, and the selected waveforms are supplied to one terminal of the piezoelectric element Pzt as drive signals, ink of an approximately medium amount is ejected twice from the nozzle N corresponding to the piezoelectric element Pzt. Accordingly, each ink is landed on and combined with the medium P, and as a result, a large dot is formed as defined by the print data SI.

When the print data SI is (0,1), the select signals Sa and Sb become H and L levels during the period T1, and thus the transfer gate 524*a* is turned on, and the transfer gate 524*b* is turned off. Accordingly, the trapezoidal waveform Adp1 of the drive signal COM-A is selected during the period T1. Next, since the select signals Sa and Sb are in L and H levels during the period T2, the trapezoidal waveform Bdp2 of the drive signal COM-B is selected.

Hence, ink of an approximately medium amount and an approximately small amount is ejected twice from the nozzle N. Accordingly, each ink is landed on and combined with the medium P, and as a result, a medium dot is formed as defined by the print data SI.

When the print data SI is (1,0), the select signals Sa and Sb become all L levels during the period T1, and thus the transfer gates 524*a* and 524*b* are turned off. Accordingly, the trapezoidal waveforms Adp1 and Bdp1 are not selected during the period T1. If the transfer gates 524*a* and 524*b* are all turned off, a path from a coupling point of the output terminals of the transfer gates 524*a* and 524*b* to one terminal of the piezoelectric element Pzt becomes a high impedance state in which the path is not electrically coupled to any portion. However, both terminals of the piezoelectric element Pzt retain a voltage (Vcen-$V_{BS}$) shortly before the transfer gates are turned off, by capacitance included in the piezoelectric element Pzt itself.

Next, since the select signals Sa and Sb are in L and H levels during the period T2, the trapezoidal waveform Bdp2 of the drive signal COM-B is selected. Accordingly, ink of an approximately small amount is ejected from the nozzle N only during the period T2, and thus small dot is formed on the medium P as defined by the print data SI.

When the print data SI is (0,0), the select signals Sa and Sb become L and H levels during the period T1, and thus the transfer gates 524*a* is turned off and the transfer gate 524*b* is turned on. Accordingly, the trapezoidal waveforms Bdp1 of the drive signal COM-B is selected during the period T1. Next, since all of the select signals Sa and Sb are in L levels during the period T2, the trapezoidal waveforms Adp2 and Bdp2 are all not selected.

Accordingly, ink near the nozzle N just slightly vibrates during the period T1, and the ink is not ejected, and thus, as a result, dots are not formed, that is, no record is made as defined by the print data SI.

In this way, the select unit 520 selects (or does not select) the drive signals COM-A and COM-B in accordance with instruction of the select control unit 510, and applies the selected signal to one terminal of the piezoelectric element Pzt. Accordingly, each of the piezoelectric elements Pzt is driven in accordance with the size of the dot which is defined by the print data SI.

The drive signals COM-A and COM-B illustrated in FIG. 5 are just an example. Actually, combinations of various waveforms which are prepared in advance are used in accordance with properties, transport speed, or the like of the medium P.

In addition, here, an example in which the piezoelectric element Pzt is bent upwardly in accordance with a decrease of a voltage is used, but if a voltage which is applied to the drive electrodes 72 and 76 is inverted, the piezoelectric element Pzt is bent downwardly in accordance with a decrease of the voltage. Accordingly, in a configuration in which the piezoelectric element Pzt is bent downwardly in accordance with a decrease of a voltage, the drive signals COM-A and COM-B illustrated in the figure have waveforms which are inverted by using the voltage Vcen as a reference.

Next, the drive circuit 120*a* and 120*b* of the main substrate 100 will be described.

The drive circuits 120*a* and 120*b* are different from each other in signals which are input and in signals which are output, and are the same as each other in configurations thereof. Hence, the drive circuits will be described by using the drive circuit 120*a* on a side which outputs the drive signal COM-A as an example.

Figure 10:
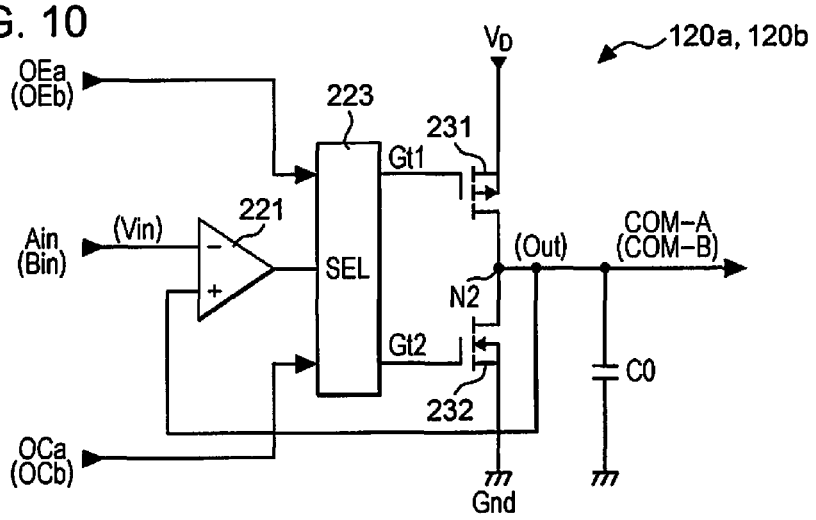
FIG. 10 is a diagram illustrating a configuration of a drive circuit which is applied to the printing apparatus.

FIG. 10 is a diagram illustrating a configuration of the drive circuit 120*a*.

As illustrated in this figure, the drive circuit 120*a* includes a differential amplifier 221, a selector 223, a pair of transistors, and a capacitor C0.

A negative input terminal (−) of the differential amplifier 221 receives the signal Ain, and the drive signal COM-A which is an output is fed back to a positive input terminal (+) of the differential amplifier 221. Accordingly, the differential amplifier 221 amplifies a difference voltage which is obtained by subtracting a voltage of the negative input terminal (−) from a voltage of the positive input terminal (+), that is, a difference voltage which is obtained by subtracting a voltage Vin of the signal Ain (source drive signal) with a large amplitude that is an input from a voltage Out of the drive signal COM-A which is an output, and outputs the amplified voltage.

However, for example, the differential amplifier 221 uses a high potential side of a power supply as a voltage $V_D$, and uses a low potential side thereof as a ground Gnd, while not particularly illustrated. Accordingly, an output voltage is within a range from the ground Gnd to the voltage $V_D$.

There is a case where an output signal of the differential amplifier 221 is also used as a signal for a switching operation which will be described below. In a case where the output signal is also used as a signal for a switching operation, an H level indicates the voltage $V_D$, and an L level indicates the ground Gnd of a zero voltage.

In addition, since the output signal of the differential amplifier 221 controls switching operations of transistors 231 and 232 after all as will be described below, the output signal can be said to be a control signal for the transistors. In addition, since a configuration may be provided in which a voltage of a drive signal is decreased and fed back and a source drive signal is voltage-amplified to output as the drive signal, and thus, it may be said that a signal based on the drive signal is fed back to the differential amplifier 221.

If the signal OEa is in an L level and the signal OCa is in an L level, the selector (select unit) 223 selects the output signal of the differential amplifier 221 as a signal Gt1, supplies the selected signal to a gate terminal of a transistor 231, selects an L level as a signal Gt2, and supplies the L level to a gate terminal of a transistor 232.

Meanwhile, if the signal OEa is in an L level and the signal OCa is in an H level, the selector 223 selects an H level as the signal Gt1, supplies the signal to the gate terminal of the transistor 231, selects the output signal of the differential amplifier 221 as the signal Gt2, and supplies the selected signal to the gate terminal of the transistor 232.

In other words, if being in a voltage increase period of the drive signal COM-A (signal Ain), the selector 223 selects the transistor 231 and supplies a difference signal which is an output signal of the differential amplifier 221 to a gate terminal of the transistor 231, and, if being in a voltage decrease period of the drive signal COM-A, the selector 223 selects the transistor 232 and supplies the difference signal to a gate terminal of the transistor 232. Meanwhile, if being in a flat voltage period of the drive signal COM-A, the selector 223 supplies signals which turn off the transistors 231 and 232 to gate terminals of each transistor, and if being in the voltage increase period or the voltage decrease period of the drive signal COM-A, the selector 223 supplies a signal which turns off the unselected transistor to the gate terminal of a corresponding transistor.

The pair of transistors are configured by transistors 231 and 232. The transistor 231 (high-side transistor) on a high side of these is, for example, a P-channel field effect transistor, and a high-side voltage $V_D$ is applied to a source terminal thereof. The transistor 232 (low-side transistor) on a low side is, for example, an N-channel field effect transistor, and a source terminal thereof is coupled to the ground Gnd which is a low side of the power supply.

Drain terminals of the transistors 231 and 232 are coupled to each other, and become a node N2 which is the output terminal of the drive circuit 120*a* (output terminal of the transistors). That is, the drive signal COM-A is configured to output from the node N2.

A voltage of the node N2 which is an output of the drive circuit 120*a* is referred to as Out, and a voltage of the signal Ain which is an input is referred to as Vin. In addition, the node N2 is coupled to the positive input terminal (+) of the differential amplifier 221 as described above. One terminal of the capacitor C0 is coupled to the node N2, and the other terminal thereof is coupled to a constant potential, for example, the ground Gnd.

Here, the drive circuit 120*a* which outputs the drive signal COM-A will be described, but a configuration of the drive circuit 120*b*, which outputs the drive signal COM-B, as denoted by a parenthesis of FIG. 10 may have a configuration in which the signal Bin is supplied to the negative input terminal (−) of the differential amplifier 221 and the signals OEb and OCb are supplied to the selector 223 while the drive signal COM-B is output from the node N2.

Next, operations of the drive circuits 120*a* and 120*b* will be described by using the drive circuit 120*a* which outputs the drive signal COM-A as an example.

Figure 11:
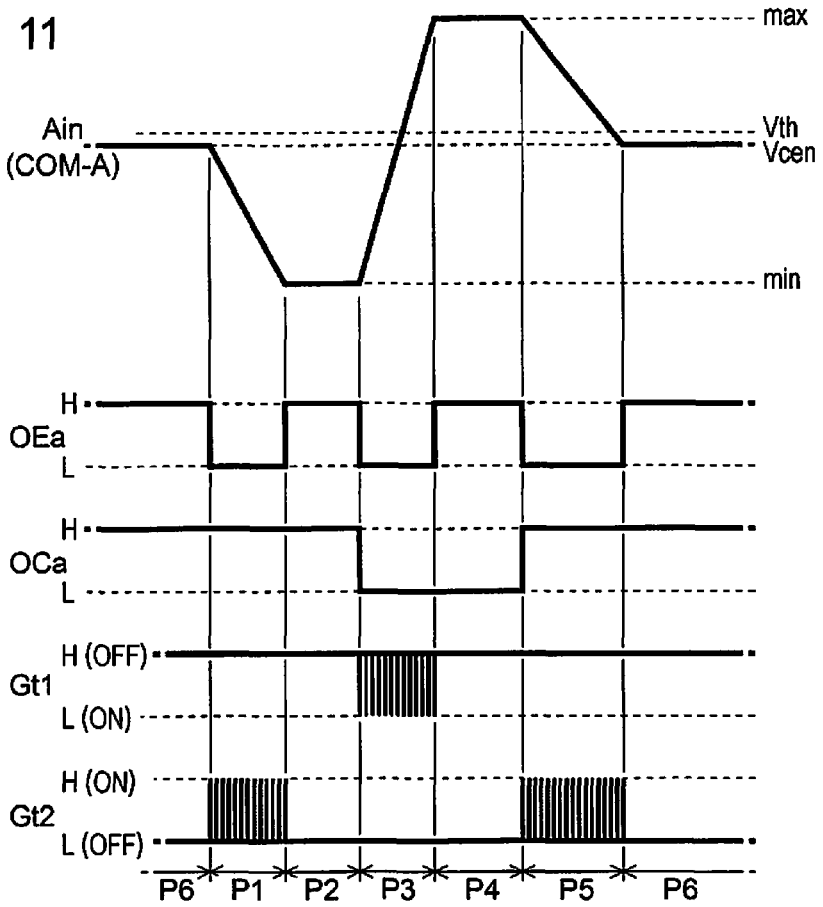
FIG. 11 is a diagram illustrating an operation of the drive circuit.

FIG. 11 is a diagram illustrating the operation of the drive circuit 120*a*.

In this figure, the signal Ain is a signal into which the drive signal COM-A is not impedance-converted, thus, having approximately the same waveform as the drive signal COM-A. In addition, as described above, the drive signal COM-A has a waveform in which two trapezoidal waveforms Adp1 and Adp2 which are the same are repeated during a print period Ta, and thus, the signal Ain also has the same waveform which is repeated.

FIG. 11 illustrates one trapezoidal waveform of the repeating waveforms. In addition, in the figure, a period P1 is a period in which the voltage Vin of the signal Ain decreases from the voltage Vcen to the minimum value min, a period P2 subsequent to the period P1 is a period in which the voltage Vin is constant at the minimum value min, a period P3 subsequent to the period P2 is a period in which the voltage Vin increases from the minimum value min to the maximum value, a period P4 subsequent to the period P3 is a period in which the voltage Vin is constant at the maximum value max, and a period P5 subsequent to the period P4 is a period in which the voltage Vin decreases from the maximum value max to the voltage Vcen.

In relation to each voltage waveform of FIG. 11, a vertical scale denoting a voltage is not necessarily assigned for the sake of convenient description.

First, the period P1 is a voltage decrease period of the drive signal COM-A (Ain). Accordingly, since the signal OEa is in an L level and the signal OCa is in an H level during the period P1, the selector 223 selects an H level as the signal Gt1 and selects the output signal of the differential amplifier 221 as the signal Gt2.

Since the signal Gt1 is in an H level during the period P1, the P-channel transistor 231 is turned off.

Meanwhile, first, the voltage Vin of the signal Ain decreases ahead of the voltage Out of the node N2 during the period P1. In other words, the voltage Out becomes a voltage higher than or equal to the voltage Vin. Accordingly, a voltage of the output signal of the differential amplifier 221 which selected as the signal Gt2 increases in accordance with the difference voltage between two voltages, and swings to an H level. If the signal Gt2 is in an H level, the transistor 232 is turned on, and thus, the voltage Out decreases. Actually, the voltage Out is not decreased to the ground Gnd immediately, and is decreased slowly by the capacitor C0, the piezoelectric element Pzt with capacitance, or the like.

If the voltage Out decreases to be lower than the voltage Vin, the signal Gt2 is in an L level, and the transistor 232 is turned off, but since the voltage Vin is low, the voltage Out increases to be higher than or equal to the voltage Vin again. Accordingly, the signal Gt2 is in an H level, and thereby, the transistor 232 is turned on again.

During the period P1, the signal Gt2 is alternately switched between an H level and an L level, and thereby, the transistor 232 performs an operation of repeating turn-on and turn-off, that is, a switching operation. By the switching operation, control of causing the voltage Out to follow a decrease of the voltage Vin is performed.

Next, the period P2 is a period in which the drive signal COM-A (Ain) is constant at the minimum value min of a voltage lower than the threshold voltage Vth. Accordingly, the signal OEa is in an H level during the period P2, and thus, the selector 223 selects an H level as the signal Gt1, selects an L level as the signal Gt2, and as a result, transistors 231 and 232 are both turned off. Thus, the node N2 is maintained in the last voltage of the period P1, that is, in a minimum value min by the capacitor C0.

Since the voltage Out is not controlled to follow the voltage Vin during the period P2, the voltage Out has an error with respect to the voltage Vin, but by increasing accuracy of the following operation during the period P1 immediately before the period P2, the error can be reduced.

The period P3 is a voltage increase period of the drive signal COM-A (Ain). Accordingly, the signal OEa is in an L level and the signal OCa is in an L level during the period P3, and thus, the selector 223 selects the output signal of the differential amplifier 221 as the signal Gt1, and selects an L level as the signal Gt2.

The signal Gt2 is in an L level during the period P3, and thus, the N-channel transistor 232 is turned off.

Meanwhile, first, the voltage Vin increases ahead of the voltage Out during the period P3. In other words, the voltage Out decreases to be lower than the voltage Vin. Accordingly, the voltage of the output signal of the differential amplifier 221 which is selected as the signal Gt1 decreases in accordance with the difference voltage between two voltages, and approximately swings to an L level. If the signal Gt1 is in an L level, the transistor 231 is turned on, and thus, the voltage Out increases. Actually, the voltage Out is not increased to the voltage $V_D$ immediately, and is increased slowly by the capacitor C0, the piezoelectric element Pzt with capacitance, or the like.

If the voltage Out is a voltage higher than or equal to the voltage Vin, the signal Gt2 is in an H level, and the transistor 231 is turned off. If the transistor 231 is turned off, an increase of the voltage Out is stopped, but since the voltage Vin increases, the voltage Out decreases to be lower than the voltage Vin again. Accordingly, the signal Gt1 is in an L level, and the transistor 231 is turned on again.

The signal Gt1 is alternately switched between an H level and an L level during the period P3, and thereby, the transistor 231 performs a switching operation. By the switching operation, control of causing the voltage Out to follow an increase of the voltage Vin is performed.

The period P4 is a period in which the drive signal COM-A (Ain) is constant at a voltage higher than or equal to the threshold voltage Vth. Accordingly, the signal OEa is in an H level during the period P4, and thus, the selector 223 selects an H level as the signal Gt1, selects an L level as the signal Gt2, and as a result, the transistors 231 and 232 are both turned off. Thus, the node N2 is maintained in the last voltage of the period P3, that is, in a maximum value max by the capacitor C0.

Since the voltage Out is not controlled to follow the voltage Vin during the period P4, the voltage Out has an error with respect to the voltage Vin, but by increasing accuracy of the following operation during the period P3 immediately before the period P4, the error can be reduced.

The period P5 is a voltage decrease period of the drive signal COM-A (Ain). Accordingly, an operation in the period P5 is the same as in the period P1. That is, the signal Gt2 is alternately switched between an H level and an L level, and thereby, the transistor 232 performs a switching operation, and control of causing the voltage Out of the node N2 to follow a decrease of the voltage Vin is performed.

A period P6 subsequent to the period P5 is a period in which the drive signal COM-A (Ain) is constant at the voltage Vcen lower than the threshold voltage Vth. Accordingly, the signal OEa is in an H level during the period P6, and thus, the selector 223 selects an H level as the signal Gt1, selects an L level as the signal Gt2, and as a result, the transistors 231 and 232 are both turned off. Thus, the node N2 is maintained in the voltage Vcen which is the last voltage of the period P5 immediately before the period P6 by the capacitor C0.

There is a case where, since the control of causing the voltage Out to follow the voltage Vin is not performed during the period P6, the voltage Out has an error with respect to the voltage Vin, but by increasing accuracy of the following operation during the period P5 immediately before the period P6, the error can be reduced.

According to the drive circuit 120*a* illustrated in FIG. 10, the control of causing the voltage Out of the drive signal COM-A to follow the voltage Vin of the signal Ain is performed by the following operation for each of the periods P1 to P6.

That is, the controls of causing the voltage Out to follow the voltage Vin are performed by the switching operation of the transistor 232 during the periods P1 and P5 in which the voltage Vin decreases, and by the switching operation of the transistor 231 during the period P3 in which the voltage Vin increases, respectively. Meanwhile, the transistors 231 and 232 are turned off and the last voltage of the switching operation immediately before being turned off is maintained during a flat period of the voltage Vin.

Description is made in which, in the drive circuit 120*a*, the transistor 231 performs a switching operation during the period P3 in which the voltage Vout (voltage Vin of the signal Ain) of the drive signal COM-A increases and the transistor 232 performs a switching operation during the periods P1 and P5 in which the voltage Vout decreases, but in a case where the number of the piezoelectric elements Pzt which are coupled is large, there may be a case where the transistor performs a linear operation in accordance with a time constant which is determined by ON resistance of the transistor and load capacitance.

In addition, the drive circuit 120*a* which outputs the drive signal COM-A is described by using as an example herein, but the drive circuit 120*b* which outputs the drive signal COM-B performs the same operation as the drive circuit 120*a*. A waveform of the drive signal COM-B is the same as the waveform illustrated in FIG. 5, and the signals OEb and OCb are the same as described above, and thus, waveforms thereof will not be illustrated. The drive circuit 120*b* also outputs the drive signal COM-B of the voltage Vout which follows a voltage of the signal Bin.

According to the drive circuit 120*a* (120*b*), the transistors 231 and 232 are both turned off during the periods P2, P4, and P6 in which the voltage Vin is constant, compared with class D amplification in which switching is continuously performed. In addition, the class D amplification requires a low pass filter (LPF) which demodulates a switching signal, particularly, an inductor such as a coil, but the drive circuit 120*a* does not require the LPF. Thus, according to the drive circuit 120*a*, it is possible to reduce power which is consumed in the switching operation or by the LPF, compared with the class D amplification, and to simplify and miniaturize a circuit.

The drive signal COM-A (COM-B) is not limited to a trapezoidal waveform, and may be a waveform with a continuous slope, such as a sine wave. In the drive circuit, in a case where the waveform is output, if a change of the voltage Vout (voltage Vin of the signal Ain) of the drive signal COM-A is relatively large, specifically, one of the transistors 231 and 232 performs a switching operation during a period in which a voltage changes to a predetermined voltage or higher on a per unit time basis. Meanwhile, if the change of the voltage Vout is relatively small, specifically, the transistors 231 and 232 may be designated to be turned off by the signal OEa (OEb) with an H level during a period in which the voltage changes to a voltage lower than the predetermined voltage on a per unit time basis or the voltage is constant without a change.

In the aforementioned description, the transistor 231 of the pair of transistors is configured by a P-channel transistor and the transistor 232 thereof is configured by an N-channel transistor, but both the transistors 231 and 232 may be P-channel transistors or N-channel transistors. The output signal (non-inverted, inverted) of the differential amplifier 221, and the signals Gt1 and Gt2 (H level, L level) in a case of being deactivated need to be appropriately modified with respect to the signal OCa (OCb) or channel types of the transistors 231 and 232.

Figure 12:
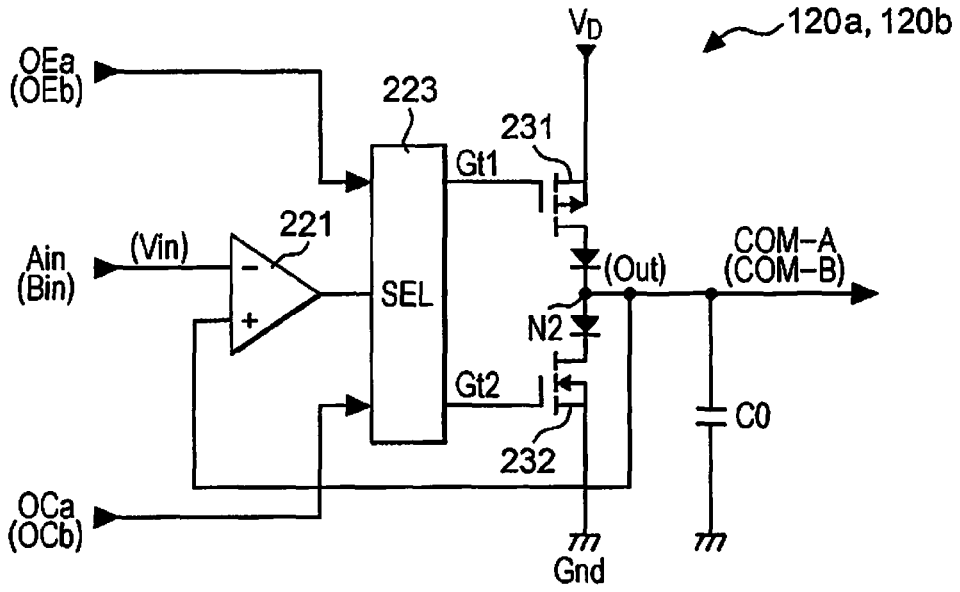
FIG. 12 is a diagram illustrating an application and modification of the drive circuit.

The drive circuits 120*a* (120*b*) may respectively include a diode for blocking a current flowing from the node N2 toward a drain terminal of the transistor 231 and a diode for blocking a current flowing from a drain terminal of the transistor 232 toward the node N2 as illustrated in FIG. 12.

The drive circuit 120*a* (120*b*), the DAC 113*a* and 113*b*, and the voltage amplifiers 115*a* and 115*b* are provided in the main substrate 100, but may be configured to be provided in the carriage 20 (or the head unit 3) which operates together with the drive IC 50. If the drive circuit 120*a* (120*b*) is provided on a side of the head unit 3, it is not necessary to supply a signal with a large amplitude through the flexible flat cable 190, and thus, it is possible to improve anti-noise characteristics.

In the above description, the liquid ejecting apparatus is described as a printing apparatus, but the liquid ejecting apparatus may be a three-dimensional shaping apparatus which ejects liquid to form a three-dimensional object, a textile printing apparatus which ejects liquid to print onto a textile, or the like.

Furthermore, in the above description, an example is described in which the piezoelectric element Pzt for ejecting ink is used as a drive target of the drive circuit 120*a* (120*b*), but when considering the drive circuit 120*a* (120*b*) which is separated from the printing apparatus, the drive target is not limited to the piezoelectric element Pzt, and can be applied to all of a load with capacitive components, such as an ultrasonic motor, a touch panel, an electrostatic speaker, or a liquid crystal panel.

A liquid ejecting apparatus according to an aspect of the embodiment includes an ejecting unit that includes a piezoelectric element which is displaced by a drive signal being applied to the piezoelectric element and ejects liquid in accordance with displacement of the piezoelectric element; a differential amplifier that outputs a control signal based on a source drive signal which is a source signal of the drive signal and a signal based on the drive signal; a pair of transistors that include a high-side transistor and a low-side transistor which are controlled based on the control signal and outputs the drive signal from an output terminal; and a select unit that selects one of the high-side transistor and the low-side transistor and supplies the control signal to the selected transistor.

According to the liquid ejecting apparatus of the aspect, a low pass filter is not needed compared with a class D amplification method, and thus, power which is consumed by the low pass filter can be ignored and power consumption is reduced by the amount consumed. An operational amplifier, a comparator, or the like can be used for a differential amplifier.

In the liquid ejecting apparatus according to the aspect, the select unit may turn off the high-side transistor and the low-side transistor, if a voltage of the source drive signal changes to be lower than or equal to a threshold value.

In the configuration, the select unit may input a signal indicating that a voltage of the source drive signal changes to be lower than or equal to a threshold value under a condition in which the voltage of the source drive signal changes to be lower than or equal to the threshold value.

In the liquid ejecting apparatus according to the aspect, the select unit may select the high-side transistor in a period in which a voltage of the source drive signal increases, and may select the low-side transistor in a period in which the voltage of the source drive signal decreases.

In addition, in the liquid ejecting apparatus according to the aspect, it is preferable that a configuration be provided in which the ejecting unit, the differential amplifier, the pair of transistors, and the select unit are mounted on a movable carriage.

The liquid ejecting apparatus may be a device which ejects liquid, and includes a three-dimensional shaping apparatus (so-called 3D printer), a textile printing apparatus, or the like, in addition to a printing apparatus which will be described below.

In addition, the embodiment is not limited to a liquid ejecting apparatus, can be realized in various aspects, and can be conceptualized as a drive circuit which drives a capacitive load such as the piezoelectric element, a head unit of a liquid ejecting apparatus, or the like.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejecting apparatus comprising:

an ejecting unit including a piezoelectric element which is configured to be displaced by a drive signal being applied to the piezoelectric element, the ejecting unit being configured to eject liquid in accordance with displacement of the piezoelectric element;

a differential amplifier configured to output a control signal based on a source drive signal, which is a source signal of the drive signal, and a signal based on the drive signal;

a pair of transistors including a high-side transistor and a low-side transistor which are configured to be controlled based on the control signal, the pair of the transistors being configured to output the drive signal from an output terminal of the pair of the transistors; and a selector configured to select one of the high-side transistor and the low-side transistor and supply the control signal to a selected transistor of the pair of the transistors, the selector being configured to simultaneously turn off both of the high-side transistor and the low-side transistor while a voltage of the drive signal is constant.

2. The liquid ejecting apparatus according to claim 1, wherein the selector is configured to simultaneously turn off both of the high-side transistor and the low-side transistor, while an OFF designation signal indicating that the voltage of the drive signal is constant is input.

3. The liquid ejecting apparatus according to claim 1, wherein the selector is configured to select the high-side transistor in a period in which a voltage of the source drive signal increases, and the selector is configured to select the low-side transistor in a period in which the voltage of the source drive signal decreases.

4. The liquid ejecting apparatus according to claim 1, wherein the ejecting unit, the differential amplifier, the pair of the transistors, and the selector are mounted on a movable carriage.

5. A drive circuit configured to drive a capacitive load in response to a drive signal, the drive circuit comprising:

a differential amplifier configured to output a control signal based on a difference voltage between a source drive signal, which is a source signal of the drive signal, and a signal based on the drive signal;

a pair of transistors including a high-side transistor and a low-side transistor which are configured to be controlled based on the control signal, the transistors being configured to output the drive signal from an output terminal of the transistors; and a selector configured to select one of the high-side transistor and the low-side transistor and supply the control signal to a selected transistor of the transistors, the selector being configured to simultaneously turn off both of the high-side transistor and the low-side transistor while a voltage of the drive signal is constant.

6. A head unit comprising:

an ejecting unit including a piezoelectric element configured to be displaced by a drive signal being applied to the piezoelectric element, the ejecting unit being configured to eject liquid in accordance with displacement of the piezoelectric element, the ejecting unit being configured to be driven by a drive circuit which includes a differential amplifier configured to output a control signal based on a difference voltage between a source drive signal, which is a source signal of the drive signal, and a signal based on the drive signal, a pair of transistors including a high-side transistor and a low-side transistor which are configured to be controlled based on the control signal, the transistors being configured to output the drive signal from an output terminal of the transistors, and a selector configured to select one of the high-side transistor and the low-side transistor and supply the control signal to a selected transistor of the transistors, the selector being configured to simultaneously turn off both of the high-side transistor and the low-side transistor while a voltage of the drive signal is constant.

* * * * *